US010832896B2

(12) United States Patent
Kobayashi et al.

(10) Patent No.: US 10,832,896 B2
(45) Date of Patent: Nov. 10, 2020

(54) ION DETECTOR

(71) Applicant: HAMAMATSU PHOTONICS K.K., Hamamatsu-shi, Shizuoka (JP)

(72) Inventors: Hiroshi Kobayashi, Hamamatsu (JP); Takeshi Endo, Hamamatsu (JP); Hiroki Moriya, Hamamatsu (JP); Toshinari Mochizuki, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 16/281,469

(22) Filed: Feb. 21, 2019

(65) Prior Publication Data

US 2019/0259591 A1 Aug. 22, 2019

(30) Foreign Application Priority Data

Feb. 22, 2018 (JP) ..... 2018-029754

(51) Int. Cl.
*H01J 43/18* (2006.01)

(52) U.S. Cl.
CPC ..... *H01J 43/18* (2013.01)

(58) Field of Classification Search
CPC ..... H01J 43/18
See application file for complete search history.

(56) References Cited

U.S. PATENT DOCUMENTS 5,326,978 A * 7/1994 Aebi ..... G01N 23/2273 250/397
5,463,219 A 10/1995 Buckley et al.
7,728,292 B2 6/2010 Jolliffe et al.
2010/0096985 A1* 4/2010 Watase ..... H01J 43/00 313/533
2014/0151529 A1* 6/2014 Steiner ..... G01J 1/44 250/207

FOREIGN PATENT DOCUMENTS

JP H07-73847 A 3/1995
JP 2013-175440 A 9/2013

* cited by examiner

*Primary Examiner* — Hugh Maupin
(74) *Attorney, Agent, or Firm* — Faegre Drinker Biddle & Reath LLP

(57) ABSTRACT

The present embodiment relates to an ion detector provided with a structure for suppressing degradation over time in an electron multiplication mechanism in the ion detector. The ion detector includes a dynode unit, serving as an electron multiplication mechanism, which multiplies secondary electrons which are emitted in response to incidence of ions, and a semiconductor detector having an electron multiplication function. Further, a focus electrode having an opening that allows passage of secondary electrons is disposed on a trajectory of secondary electrons which are directed from the dynode unit toward the semiconductor detector, and the focus electrode functions to guide secondary electrons from the dynode unit onto an electron incidence surface of the semiconductor detector.

13 Claims, 9 Drawing Sheets

ION DETECTOR

TECHNICAL FIELD

The present invention relates to an ion detector including an electron multiplication mechanism.

BACKGROUND

Hitherto, in technical fields such as inductively coupled plasma mass spectrometry (ICP-MS), ion detectors have been used. Particularly, an ion detector which is applied to detection of a very small amount of ions includes an electron multiplication mechanism that generates secondary electrons in response to the incidence of ions in order to detect the detection amount of ions which are charged particles as an electrical signal, and cascade-multiplies the generated secondary electrons up to a detectable level to thereby generate an electrical signal corresponding to the amount of ions. Meanwhile, an ICP-MS device is provided with a plurality of output ports for extracting secondary electrons from any place of an electron multiplication mechanism that cascade-multiplies secondary electrons in order to realize a wide dynamic range exceeding 9 digits in ion detection (multi-mode output).

As an example of such a multi-mode ion detector, U.S. Pat. No. 5,463,219 (Patent Document 1) discloses a dual-mode ion detector in which an electron multiplication mechanism is constituted by dynodes of twenty or more stages, and two output ports are provided at different positions of the electron multiplication mechanism.

One of the two output ports of the dual-mode ion detector disclosed in Patent Document 1 which extracts an electrical signal at a level with a low electron multiplication factor is called an analog port (hereinafter, this is referred to as an "analog mode output terminal", and signal output from such an output terminal is referred to as "analog mode output"). On the other hand, an output port that extracts an electronic signal after electron multiplication is further performed is called a counting port (hereinafter, this is referred to as a "counting mode output terminal", and signal output from such an output terminal is referred to as "counting mode output"). That is, the dual-mode ion detector is an ion detector capable of switching a signal output mode in accordance with the amount of ions to be detected by alternatively using any of output terminals of two modes having different electron multiplication factors.

Specifically, in the dual-mode ion detector disclosed in Patent Document 1, the analog mode output is signal output in a case where the amount of ions is large, and some of secondary electrons reaching a dynode located at an intermediate position (hereinafter, referred to as an "intermediate dynode") among dynodes having a multistage configuration are captured by an adjacent anode electrode in order to keep an electron multiplication factor low. On the other hand, the counting mode output is signal output in a case where the amount of ions is small, and secondary electrons which are output from a final-stage dynode are captured by an anode electrode in order to secure a sufficient electron multiplication factor.

SUMMARY

The inventors have examined an ion detector of the related art, particularly, a dual-mode ion detector having an electron multiplication mechanism in detail, and have found the following problem.

That is, in the dual-mode ion detector disclosed in Patent Document 1, a considerable number of dynodes are prepared in order to secure a sufficient electron multiplication factor in counting mode output between an intermediate dynode for analog mode output and a final-stage dynode. However, as compared with electron collisions in a preceding stage portion from an initial-stage dynode to the intermediate dynode, the number of electron collisions in a subsequent stage portion from the intermediate dynode to the final-stage dynode increases conspicuously. Normally, the number of stages of dynodes constituting an electron multiplication mechanism of a dual-mode ion detector is more than two times (twenty or more stages) the number of stages of dynodes applied to a general electron multiplier tube. For this reason, a large number of carbon atoms are attached to the dynode surface of the subsequent stage portion in association with electron collisions (carbon contamination). From such a structural feature, the decrease rate of the electron multiplication factor of the subsequent stage portion becomes faster than the decrease rate of the electron multiplication factor of the preceding stage portion (the effective operation period of counting mode output becomes shorter than the effective operation period of analog mode output).

The present invention was contrived in order to solve the above problem, and an object thereof is to provide a multi-mode ion detector provided with a structure for effectively suppressing degradation over time in an electron multiplication mechanism.

An ion detector according to the present embodiment is provided with a structure enabling not only a dual-mode operation capable of both analog mode output and counting mode output, but also a single-mode operation specialized for the counting mode output, and with a structure capable of effectively suppressing degradation over time in an electron multiplication mechanism. Specifically, the ion detector includes an ion incidence portion, a conversion dynode, a dynode unit, a first electron detection unit, and a focus electrode. The ion incidence portion takes up ions which are charged particles into the ion detector. The conversion dynode is disposed at a position where ions taken up through the ion incidence portion reach, and emits secondary electrons in response to incidence of the ions. The dynode unit is constituted by multiple stages of dynodes disposed along a predetermined electron multiplication direction in order to cascade-multiply secondary electrons emitted from the conversion dynode. Meanwhile, an electron multiplication mechanism of the ion detector is constituted by at least the conversion dynode and the dynode unit. The first electron detection unit includes a semiconductor detector having an electron multiplication function, and the semiconductor detector is disposed at a position where secondary electrons emitted from a final-stage dynode included in the dynode unit reach. The focus electrode is disposed on a trajectory of secondary electrons which are directed from the final-stage dynode toward the first electron detection unit, and has an opening for allowing passage of secondary electrons emitted from the final-stage dynode.

Meanwhile, each embodiment of the present invention can be more fully understood from the following detailed description and the accompanying drawings. These examples are given for the purpose of illustration only, and are not to be considered as limiting the present invention.

In addition, the further scope of applicability of the present invention will become apparent from the following detailed description. However, it should be understood that the detailed description and specific examples, while indicating preferred embodiments of the invention, are given for the purpose of illustration only, and that various changes and modifications within the spirit and scope of the invention will be apparent to those skilled in the art from this detailed description.

DETAILED DESCRIPTION

Figure 1:
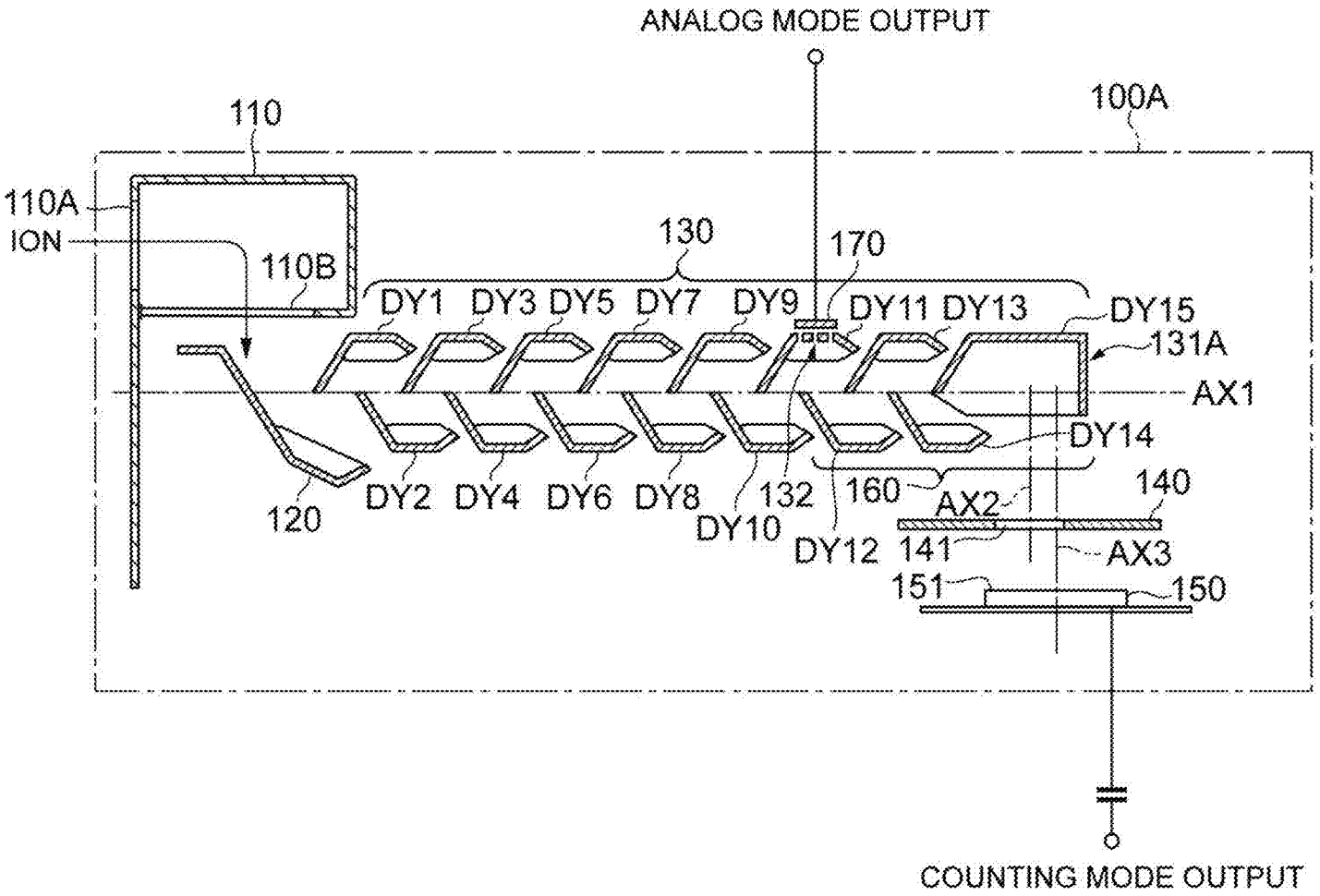
FIG. 1 is a cross-sectional view illustrating a representative configuration example of main parts of an ion detector according to the present embodiment.

Description of Embodiment of the Present Invention

First, contents of an embodiment of the present invention will be individually listed and described.

(1) An ion detector according to the present embodiment is provided with a structure enabling not only a dual-mode operation capable of both analog mode output and counting mode output, but also a single-mode operation specialized for the counting mode output, and with a structure capable of effectively suppressing degradation over time in an electron multiplication mechanism. Particularly, as an aspect of the present embodiment, the ion detector includes an ion incidence portion, a conversion dynode, a dynode unit, a first electron detection unit, and a focus electrode. The ion incidence portion takes up ions which are charged particles into the ion detector. The conversion dynode is disposed at a position where ions taken up through the ion incidence portion reach, and emits secondary electrons in response to incidence of the ions. The dynode unit is constituted by multiple stages of dynodes disposed along a predetermined electron multiplication direction in order to cascade-multiply secondary electrons emitted from the conversion dynode. Meanwhile, an electron multiplication mechanism of the ion detector is constituted by at least the conversion dynode and the dynode unit. The first electron detection unit includes a semiconductor detector having an electron multiplication function, and the semiconductor detector is disposed at a position where secondary electrons emitted from a final-stage dynode included in the dynode unit reach. The focus electrode is disposed on a trajectory of secondary electrons which are directed from the final-stage dynode toward the first electron detection unit, and has an opening for allowing passage of secondary electrons emitted from the final-stage dynode.

(2) As an aspect of the present embodiment, it is preferable that the final-stage dynode included in the dynode unit has a first wall portion extending along a direction intersecting the electron multiplication direction. In this case, the focus electrode and the semiconductor detector are disposed along a traveling direction of secondary electrons deflected by the first wall portion of the final-stage dynode. In addition, as an aspect of the present embodiment, the first wall portion of the final-stage dynode included in the dynode unit may extend along a direction orthogonal to the electron multiplication direction. In this case, it is preferable that the focus electrode is disposed so that a first normal line that passes through a center of the opening is orthogonal to the electron multiplication direction. Similarly, it is preferable that the semiconductor detector is disposed so that second normal line that passes through a center of an electron incidence surface of the semiconductor detector is orthogonal to the electron multiplication direction. Further, as an aspect of the present embodiment, it is preferable that the focus electrode and the semiconductor detector are disposed so that the first normal line and the second normal line deviate from each other along the electron multiplication direction.

As described above, since the first wall portion provided in the final-stage dynode has a function of deflecting the trajectory of secondary electrons emitted from the final-stage dynode in the electron multiplication direction, it is possible to arbitrarily set the installation positions of the focus electrode and the semiconductor detector with respect to the dynode unit. In addition, considering a reduction in the size of the ion detector, it is preferable that the first wall portion extends along a direction orthogonal to the electron multiplication direction. However, in this case, in order to more accurately control the trajectory of the secondary electrons, the focus electrode and the semiconductor detector are disposed so that the first normal line and the second normal line are deviate from each other along the electron multiplication direction.

(3) On the other hand, as an aspect of the present embodiment, the focus electrode may be disposed so that a third normal line that passes through a center of the opening is parallel to the electron multiplication direction. Similarly, the semiconductor detector may be disposed so that a fourth normal line that passes through a center of an electron incidence surface of the semiconductor detector is parallel to the electron multiplication direction.

(4) As an aspect of the present embodiment, the focus electrode has a second wall portion extending along a direction intersecting the electron multiplication direction. A shielding effect within the ion detector can be improved by the presence of this second wall portion.

(5) As an aspect of the present embodiment, it is preferable that the ion detector is configured such that a base portion on which each part is mounted is divided into a plurality of substrates. For example, in a case where the base portion is constituted by first and second support substrates, an electrode unit including at least the conversion dynode, the dynode unit, and the focus electrode is mounted on the first support substrate. In addition, at least the first electron detection unit is mounted on the second support substrate in a state of being electrically insulated from the first support substrate. In this case, since a plurality of support substrates are electrically insulated from each other, it is possible to effectively suppress the generation of creeping discharge. In addition, as an aspect of the present embodiment, a relative position between the first and second support substrates is fixed in a state where the first and second support substrates are capable of being physically separated from each other. In the case of the present embodiment, the semiconductor detector takes charge of an electron multiplication function (for example, electron multiplication function of the subsequent stage portion of the dynode unit in the configuration disclosed in U.S. Pat. No. 5,463,219) for obtaining the counting mode output. In this case, the semiconductor detector is required to be replaced due to the attachment of carbon onto the electron incidence surface (carbon contamination). Therefore, a support substrate having the electrode unit mounted thereon and a support substrate having the semiconductor detector mounted thereon are physically separated from each other, so that the replacement of parts in the ion detector is facilitated.

(6) As an aspect of the present embodiment, the ion detector may further include a second electron detection unit having an electrode for capturing at least some of secondary electrons. That is, the above-described configuration in which the first electron detection unit is included (single-mode configuration capable of at least the counting mode output) is capable of multi-mode ion detection by further including another electron detection unit. Meanwhile, when mention is made of a dual mode only, it is preferable that the electrode of the second electron detection unit is disposed adjacent to any intermediate dynode other than the final-stage dynode among dynodes constituting the dynode unit. In this case, at least some of secondary electrons having reached the intermediate dynode are captured by the electrode. On the other hand, as an aspect of the present embodiment, the electrode of the second electron detection unit may include any intermediate dynode other than the final-stage dynode among dynodes constituting the dynode unit. In this case, the intermediate dynode functioning as the electrode of the second electron detection unit is grounded (GND).

Hereinbefore, each aspect listed in the section of this [Description of Embodiment of the present invention] can be applied to each of all the remaining aspects or to all combinations of these remaining aspects.

Details of Embodiment of the Present Invention

Hereinafter, specific examples of an ion detector according to the present invention will be described in detail with reference to the accompanying drawings. Meanwhile, the present invention is not limited to these examples but is defined by the appended claims, and is intended to include all changes and modifications within the scope and meaning equivalent to the scope of the claims. In addition, in the description of the drawings, the same components are denoted by the same reference numerals and signs, and may not be described.

First Embodiment

Figure 2A:
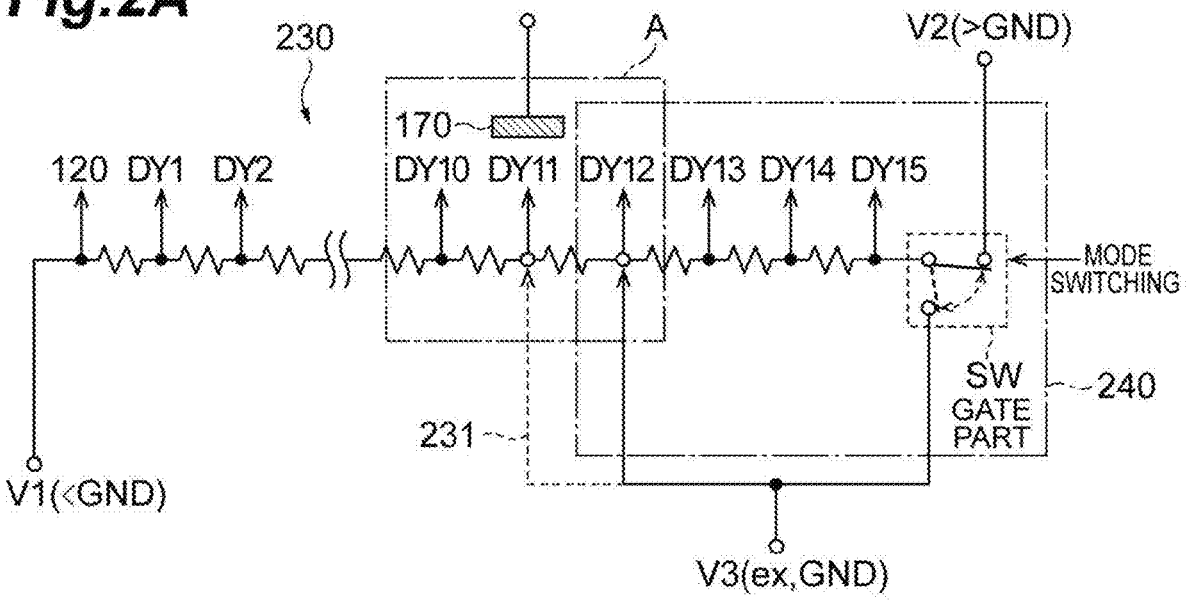
FIGS. 2A to 2C are diagrams illustrating a gate function of the ion detector according to the present embodiment.
Figure 2B:
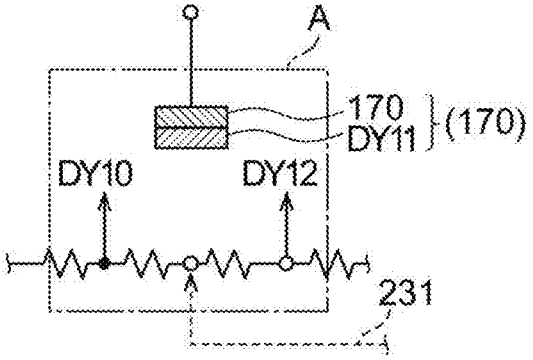
Figure 2C:
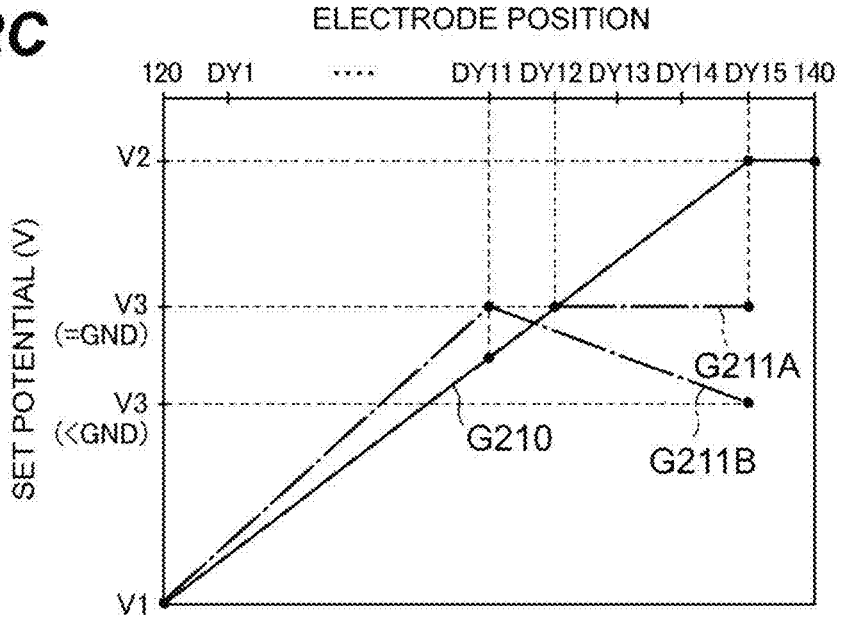

FIG. 1 is a cross-sectional view illustrating a representative configuration example of main parts in an ion detector 100A according to a first embodiment. In addition, FIGS. 2A to 2C are diagrams illustrating a gate function of the ion detector 100A according to the first embodiment which is shown in FIG. 1. Particularly, FIG. 2A shows a configuration of a bleeder circuit 230 including a gate part 240, FIG. 2B shows a portion shown by a region A in FIG. 2A, particularly, another structure of an anode electrode 170, and FIG. 2C is a graph illustrating an example of potential setting of each electrode for realizing a gate function.

As shown in FIG. 1, the ion detector 100A according to the first embodiment includes an ion incidence portion 110, a conversion dynode 120, a dynode unit 130 constituted by multiple stages of dynodes DY1 to DY15, a focus electrode 140, and an avalanche diode (hereinafter, referred to as an "AD") 150 serving as a semiconductor detector included in a first electron detection portion. Meanwhile, the AD 150 is a semiconductor device having a function of multiplying secondary electrons having reached an electron incidence surface 151. Further, the ion detector 100A includes an anode electrode 170 constituting a portion of a second electron detection portion 700 (see FIG. 5). Electrons on which electron multiplication is performed by the AD 150 are output from the AD 150 of the first electron detection portion, as an electrical signal, through a coupling capacitor (counting mode output). In addition, secondary electrons captured by the anode electrode 170 are output from the anode electrode 170 of the second electron detection portion 700, as an electrical signal, through the coupling capacitor (analog mode output).

The ion incidence portion 110 includes an incidence port 110A for taking up ions which are charged particles into the ion detector 100A and an emission port 110B for guiding the taken-up ions to the conversion dynode 120. The relative position between the incidence port 110A and the emission port 110B is adjusted, so that the trajectory of ions which are directed toward the conversion dynode 120 is controlled (ion trajectory control function of the ion incidence portion 110). The conversion dynode 120 is an electrode that functions to emit secondary electrons into the ion detector 100A in response to the incidence of ions having had the trajectory thereof controlled by the ion incidence portion 110. The dynode unit 130 is constituted by multiple stages of dynodes DY1 to DY15 which are disposed along a predetermined electron multiplication direction AX1. That is, the secondary electrons emitted from the conversion dynode 120 are incident on the first-stage dynode DY1, and then is cascade-multiplied from the dynode DY1 toward the final-stage dynode DY15. The focus electrode 140 is an electrode for guiding secondary electrons emitted from the final-stage dynode DY15 to the electron incidence surface 151 of the AD 150, and has an opening 141 for allowing passage of the secondary electrons.

The anode electrode 170 is disposed adjacent to the eleventh-stage dynode (hereinafter, referred to as the "intermediate dynode") DY11 among dynodes constituting the dynode unit 130. In addition, the intermediate dynode DY11 is provided with a mesh structure 132 for allowing passage of some of secondary electrons having reached the intermediate dynode DY11 toward the anode electrode 170. On the other hand, an electrode group of dynodes subsequent to the intermediate dynode DY11, that is, the twelfth-stage dynode DY12 to the final-stage dynode DY15 constitutes a gate dynode group 160 that functions as a gate electrode constituting a portion of the gate part 240 (see FIG. 2A). Meanwhile, the gate part 240 can perform control of switching between passage and interruption of secondary electrons which are directed from the intermediate dynode DY11 toward the AD 150 by adjusting the set potential of a gate electrode at any timing. The gate part may include at least one dynode (substantially, at least the final-stage dynode DY15) as a gate electrode.

In the configuration example of FIG. 1, an electrode unit 600 (see FIG. 5) is constituted by the conversion dynode 120, the multiple stages of dynodes DY1 to DY15 constituting the dynode unit 130, and the focus electrode 140 which are described above. In addition, a gain of approximately 1 to $10^5$ is obtained in a preceding stage portion from the conversion dynode 120 to the eleventh-stage intermediate dynode DY11. The gate dynode group 160 (the twelfth-stage dynode DY12 to the final-stage dynode DY15) included in the gate part 240 is a gate electrode for substantially realizing a gate function, and thus its gain may be approximately 1 to 20. The gain of the AD 150 may be approximately $5\times10^3$ to $10^4$. In this manner, in the present embodiment, since a portion of an electron multiplication function in a dynode unit of the related art is realized by the AD 150, the preceding stage portion from the conversion dynode 120 to the intermediate dynode DY11 and the subsequent stage portion (gate dynode group 160) from the twelfth-stage dynode DY12 to the final-stage dynode DY15 differ from each other in electron multiplication capability. Specifically, the electron multiplication factor of the preceding stage portion including the conversion dynode 120 becomes larger than the electron multiplication factor (electron multiplication factor of the gate dynode group 160) of the subsequent stage portion. In other words, the number of stages of the dynodes of the preceding stage portion including the conversion dynode 120 becomes larger than the number of stages of the dynodes of the subsequent stage portion.

The final-stage dynode DY15 is provided with a wall portion 131A, and this wall portion 131A functions to correct the trajectory of secondary electrons emitted from the final-stage dynode DY15 in a direction intersecting the electron multiplication direction AX1. In the configuration example of FIG. 1, in consideration of a reduction in the size of the ion detector 100A, the wall portion 131A extends along a direction orthogonal to the electron multiplication direction AX1. The focus electrode 140 is disposed so that a normal line AX2 that passes through the center of the opening 141 is orthogonal to the electron multiplication direction AX1. In addition, the AD 150 is also disposed so that a normal line AX3 that passes through the center of the electron incidence surface 151 is orthogonal to the electron multiplication direction AX1. In addition, in order to more accurately control the trajectory of the secondary electrons, the focus electrode 140 and the AD 150 are disposed so that the normal lines AX2 and AX3 deviate from each other along the electron multiplication direction AX1.

Each of the potentials of the conversion dynode 120 and the dynodes DY1 to DY15 constituting the dynode unit 130 is set by, for example, the bleeder circuit 230 shown in FIG. 2A. That is, the conversion dynode 120 side is set to have a potential of V1 (<GND), and the final-stage dynode DY15 side is set to have a potential of V2 (>GND). The dynodes DY1 to DY14 are set to have predetermined potentials using a voltage drop of each resistor which is connected directly. Meanwhile, the potential settings of the dynodes DY12 to DY15 constituting the gate dynode group 160 are performed by the gate part 240. In the example of FIG. 2A, the potential of the twelfth-stage dynode DY12 is set to V3 (<V2). The gate part 240 has a switch SW so that the potential of the final-stage dynode DY15 switches between a potential V2 and a potential V3 (mode switching). Here, since the potential of the eleventh-stage intermediate dynode DY11 is lower than the potential V3 of the twelfth-stage dynode DY12, the potential of the anode electrode 170 may be higher than V3. As an example, in a case where the twelfth-stage dynode DY12 is grounded (GND), the potential of the anode electrode 170 is set to a positive potential (>GND).

In the case of counting mode output, the potential of each electrode from the conversion dynode 120 to the final-stage dynode DY15 is set as shown in a graph G210 of FIG. 2C. Meanwhile, the potential of the focus electrode 140 is set by a power supply separate from that of the bleeder circuit 230 shown in FIG. 2A. On the other hand, in a case where mode switching performed from the counting mode output to the analog mode output is performed by the switch SW, the potentials of the dynodes DY12 to DY15 constituting the gate dynode group 160 are all set to V3 (graph G211A of FIG. 2C). Since the potential of the anode electrode 170 is set to be higher than V3, a function of shielding secondary electrons by the gate part 240 is realized. Meanwhile, the graph G211A of FIG. 2C shows a case where the dynodes DY12 to DY15 are set to have a common potential of V3, but the twelfth dynode DY12 is set to have a potential of V3 (=GND), and the final-stage dynode DY15 is set to have a potential of V3 (<GND), so that a potential gradient such as a graph G211B may be formed. In any case, in the present embodiment, the gate part 240 that realizes such shielding of secondary electrons is included, whereby reliable signal output from an analog mode output terminal is obtained, and the degradation of the AD 150 is effectively suppressed.

Figure 3:
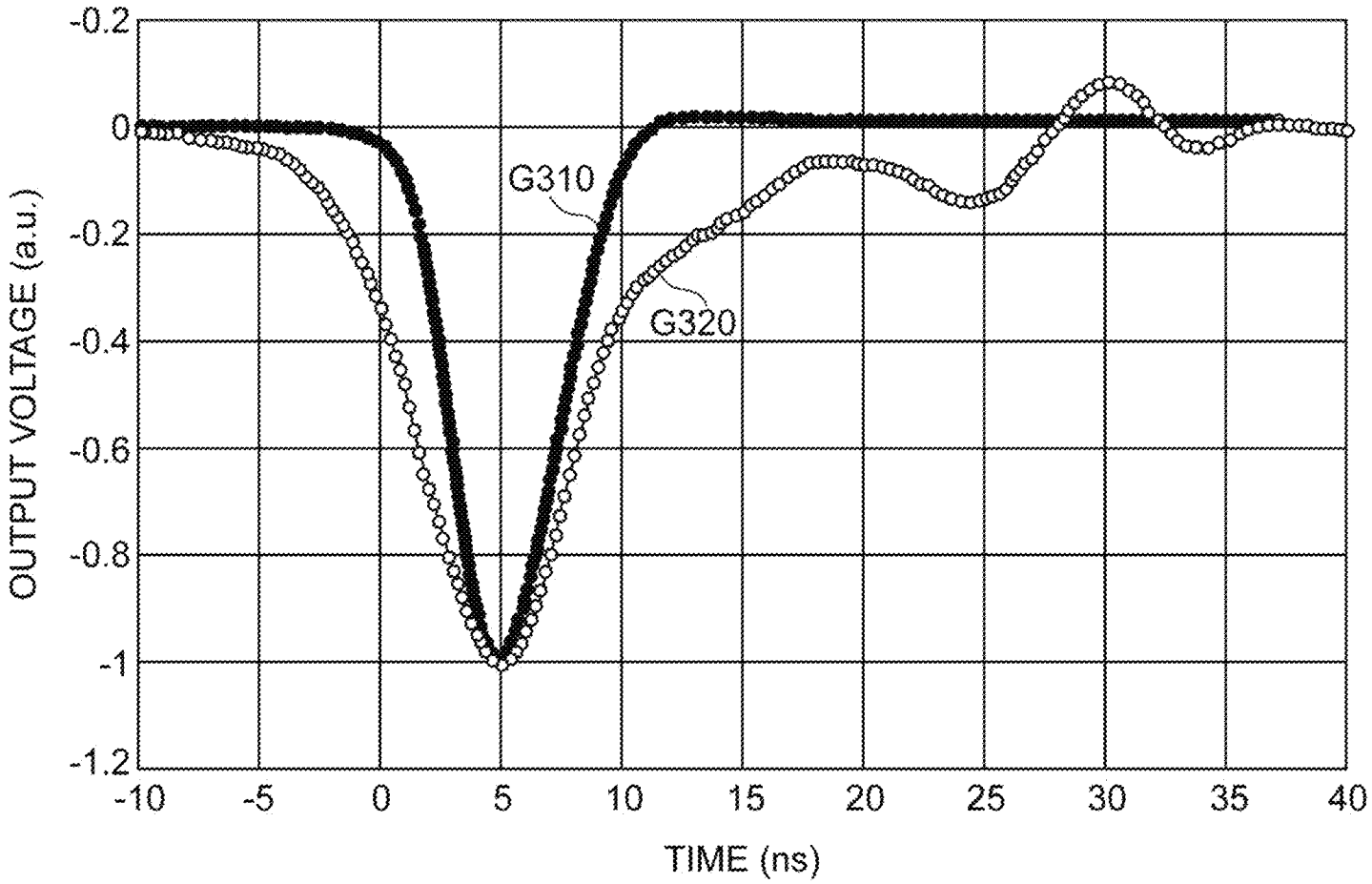
FIG. 3 is a graph illustrating a waveform of each counting mode output as the time characteristics of the ion detector according to the present embodiment and an ion detector according to a comparative example.

FIG. 3 is a graph illustrating a waveform of each counting mode output as the time characteristics of the ion detector according to the present embodiment and an ion detector according to a comparative example. In FIG. 3, the horizontal axis represents a time (ns), and the vertical axis represents an output voltage (a.u.). In addition, a graph G310 shows a waveform of counting mode output of the ion detector 100A according to the present embodiment, and a graph G320 shows a waveform of counting mode output of an ion detector (Patent Document 1 stated above) according to a comparative example. Meanwhile, the graph G310 and the graph G320 are graphs which are normalized peak values are identical with each other.

In the ion detector according to the comparative example, the set potential of each electrode for obtaining the counting mode output follows the description of Patent Document 1 stated above. On the other hand, in the ion detector 100A according to the present embodiment, the set potential of each electrode for obtaining the counting mode output falls within a range described later. In the comparative example, secondary electrons multiplied in the preceding stage portion of an electron multiplication mechanism are used as the analog mode output, and secondary electrons multiplied in both the preceding stage portion and the subsequent stage portion continuous therewith are used as the counting mode output. On the other hand, in the ion detector 100A according to the present embodiment, the structure of the preceding stage portion of the electron multiplication mechanism for obtaining the analog mode output is similar to that of the comparative example, but a portion equivalent to the subsequent stage portion (electron multiplication function) of the comparative example is taken charge of by the AD 150 with the exception of some dynodes functioning as a gate electrode. In this manner, it can be understood from FIG. 3 that a structural difference in particularly the subsequent stage portion of the electron multiplication mechanism for obtaining the counting mode output is a difference between the shapes of the graph G310 and the graph G320.

That is, in FIG. 3, the full width at half maximum of the graph G320 indicating the time characteristics of the comparative example is 8 ns, whereas the full width at half maximum of the graph G310 indicating the time characteristics of the present embodiment is 5 ns. In this manner, according to the present embodiment in which the AD 150 takes charge of a portion (subsequent stage portion except dynodes functioning as a gate electrode) of the electron multiplication function of the electron multiplication mechanism for obtaining the counting mode output, the temporal spread of an output signal caused by a variation in a time which will be taken for secondary electrons to arrive at an electrode or an incidence part that captures the secondary electrons is suppressed, and an improvement in the time characteristics of an ion detector becomes conspicuous.

Figure 4:
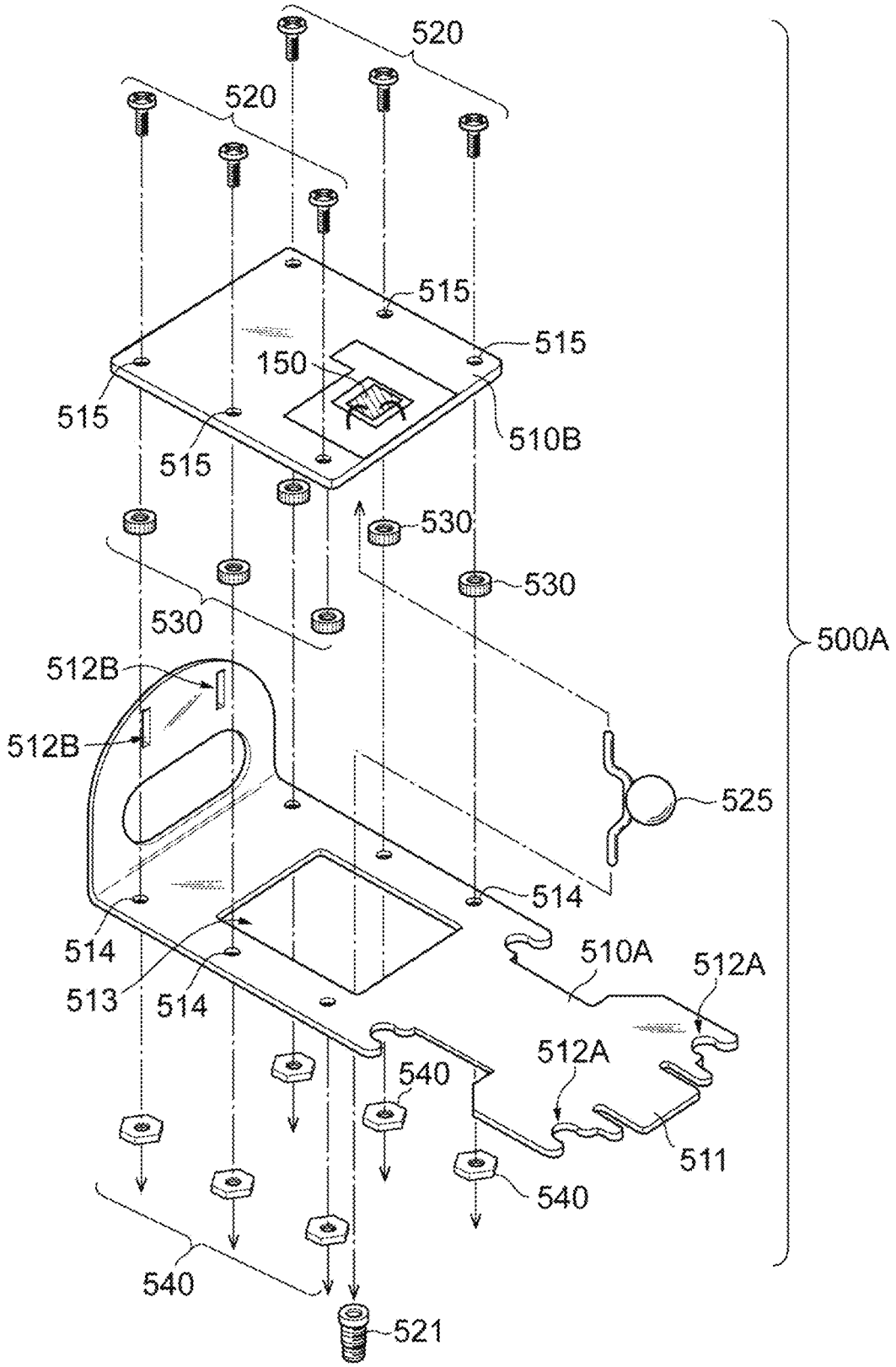
FIG. 4 is an assembly process diagram illustrating a representative structure of a base portion in the ion detector according to the present embodiment.
Figure 5:
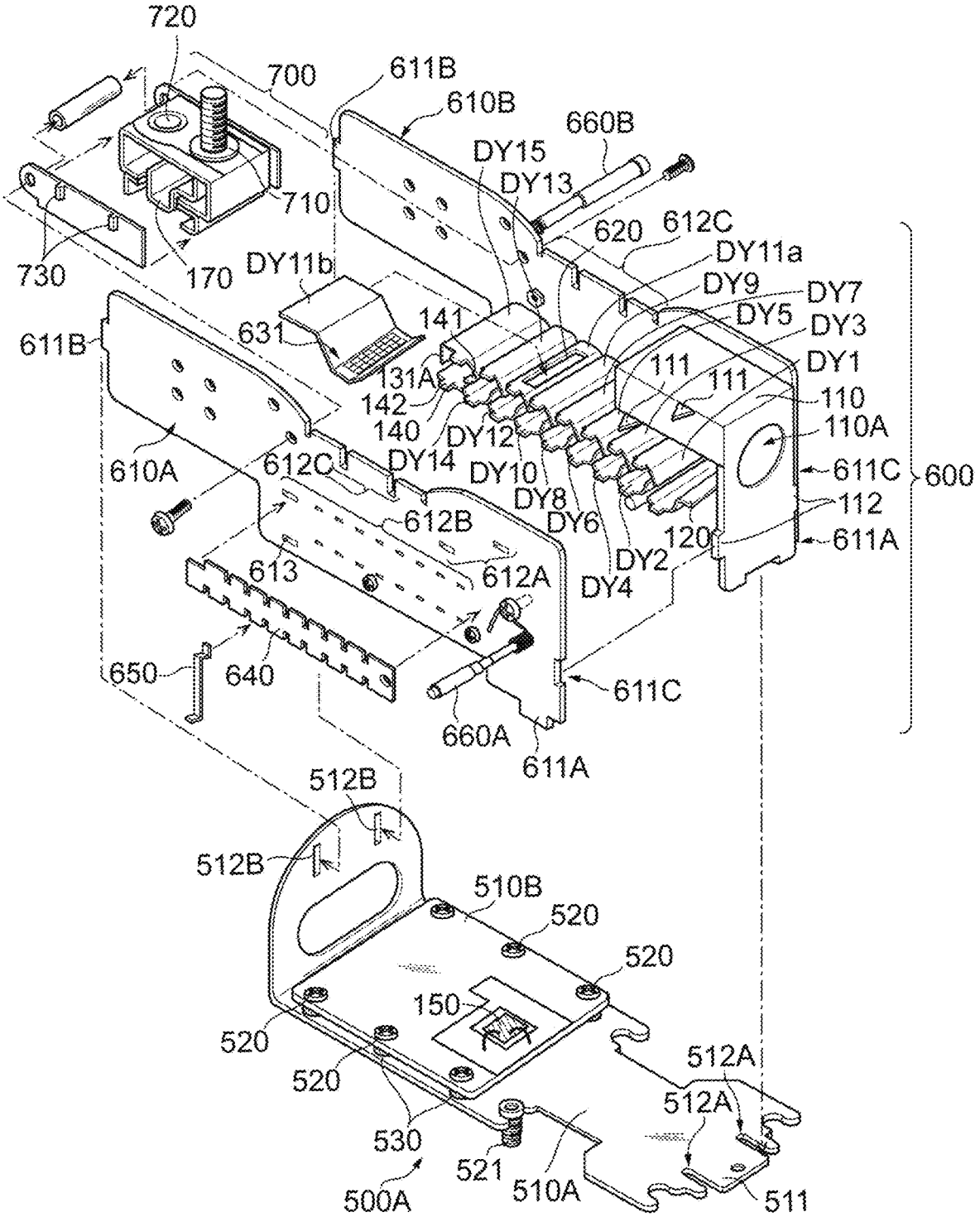
FIG. 5 is an assembly process diagram illustrating a representative configuration example of the ion detector according to the present embodiment.

Next, an assembly process of the ion detector 100A according to the first embodiment will be described with reference to FIGS. 4 and 5. Meanwhile, FIG. 4 is an assembly process diagram illustrating a representative structure of a base portion 500A in the ion detector 100A according to the first embodiment. In addition, FIG. 5 is an assembly process diagram illustrating a representative configuration example of the ion detector 100A according to the first embodiment.

As shown in FIG. 4, the base portion 500A includes a first support substrate 510A and a second support substrate 510B which are fixed to each other with the substrates electrically insulated from each other. The first support substrate 510A has the electrode unit 600 (see FIG. 5) mounted thereon which mainly includes the conversion dynode 120, the dynode unit 130, and the focus electrode 140. On the other hand, the second support substrate 510B has the AD 150 mounted thereon.

The first support substrate 510A has a shape of which the rear portion is upright, and is provided with an opening 513 at a position confronting the second support substrate 510B. The front portion of the first support substrate 510A is provided with a support portion 511 for supporting the ion incidence portion 110 mounted on the electrode unit 600, and is provided with a positioning slit 512A for defining the mounted position of the electrode unit 600. On the other hand, the rear portion of the first support substrate 510A is also provided with a positioning hole 512B for defining the mounted position of the electrode unit 600. Further, fixing holes 514 for defining the fixed position of the second support substrate 510B are formed in the periphery of the opening 513.

The upper surface (surface confronting the focus electrode 140 held by the electrode unit 600) of the second support substrate 510B has the AD 150 mounted thereon, and has an electrode pad for voltage application formed thereon so as to surround the AD 150. One end of a coupling capacitor 525 is connected to the rear surface of a second support substrate 520B, whereas the other end of the coupling capacitor 525 is inserted into a counting mode output terminal (counting port) 521. In addition, fixing holes 515 provided corresponding to the fixing holes 514 are formed in the vicinity of the second support substrate 520B.

In a state where the positions of the fixing holes 515 and the positions of the fixing hole 514 are made coincident with each other, the second support substrate 510B is placed on the first support substrate 510A with insulating spacers 530 interposed therebetween. In this state, bolts 520 are inserted from the upper surface side of the second support substrate 510B so as to pass through the fixing holes 515, the insulating spacers 530, and the fixing holes 514. Nuts 540 are attached to the tips of the bolts 520 protruding from the rear surface side of the first support substrate 510A, so that the relative position between the first support substrate 510A and the second support substrate 510B is fixed.

As described above, since the first support substrate 510A and the second support substrate 510B are electrically insulated from each other with the insulating spacers 530 interposed therebetween, it is possible to effectively suppress the generation of creeping discharge. In addition, the second support substrate 510B is fixed to the first support substrate 510A in a state of being capable of being physically separated from each other. Therefore, in a case where the AD 150 is required to be replaced due to the attachment of carbon onto the electron incidence surface 151, the replacement of the AD 150 is facilitated.

Further, as shown in FIG. 5, the electrode unit 600 includes the ion incidence portion 110, the conversion dynode 120, the dynodes DY1 to DY15 constituting the dynode unit 130, the focus electrode 140, and a pair of insulating support substrates 610A and 610B for integrally grasping the second electron detection portion 700 including the anode electrode 170.

The rear portion of the insulating support substrate 610A out of the pair of insulating support substrates 610A and 610B is provided with a fixed piece 611B which is inserted into the positioning hole 512B provided in the rear portion of the first support substrate 510A. In addition, the front portion thereof is provided with a fixed piece 611A which is inserted into the positioning slit 512A provided to the rear portion of the first support substrate 510A and a positioning notch 611C for fixing the ion incidence portion 110 to a predetermined position. Further, the insulating support substrate 610A is provided with positioning holes 612A for fixing the ion incidence portion 110 to a predetermined position, positioning holes 612B for fixing the conversion dynode 120 and each of the dynodes DY1 to DY15 to predetermined positions, positioning slits 612C for fixing the second electron detection portion 700 to a predetermined position, and a positioning hole 613 for fixing the focus electrode 140 to a predetermined position. Meanwhile, the insulating support substrate 610B also has the same structure as that of the insulating support substrate 610A. In addition, a dynode supply pin 660A that supplies a potential V1 to the conversion dynode 120 is attached to the insulating support substrate 610A side, and a gate supply pin 660B that supplies a potential V2 to the final-stage dynode DY15 is attached to the insulating support substrate 610B side.

Figure 8A:
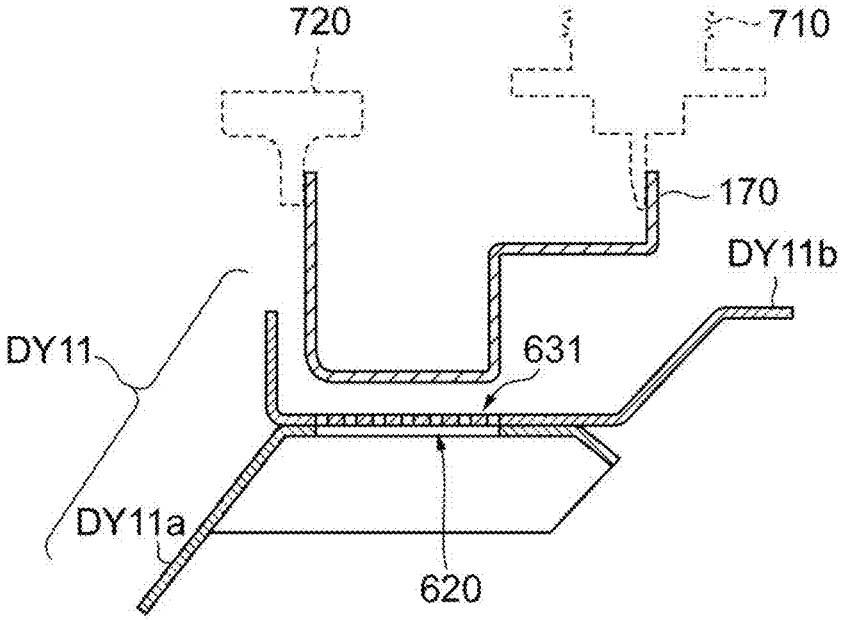
FIGS. 8A and 8B are diagrams illustrating examples of various electrode structures in a second electron detection portion (analog mode output) which are capable of being applied to the present embodiment.

The intermediate dynode DY11 in which the mesh structure 132 is formed among the dynodes DY1 to DY15 constituting the dynode unit 130 has a structure shown in FIG. 8A. That is, the intermediate dynode DY11 is constituted by a dynode body DY11*a* provided with an opening 620 for allowing passage of secondary electrons that reach the intermediate dynode, and a mesh structure DY11*b* in which a mesh portion 631 is formed. The mesh structure DY11*b* is fixed directly to the dynode body DY11*a* in a state where the opening 620 and the mesh portion 631 are coincident with each other.

The ion incidence portion 110 out of components grasped by the pair of insulating support substrates 610A and 610B is provided with a fixed piece fitted to the positioning notch 611C and fixed pieces 111 inserted into the positioning holes 612A of the insulating support substrates 610A and 610B, on the front surface where the incidence port 110A is provided. The conversion dynode 120 and the dynodes DY1 to DY15 are also provided with fixed pieces inserted into the positioning holes 612B. The focus electrode 140 is provided with a fixed piece 142 inserted into the positioning hole 613.

The second electron detection portion 700 includes a housing which is set to have a GND potential, an analog mode output terminal (analog port) 710, a hermetic seal (insulating member) 720, and the anode electrode 170. The analog mode output terminal 710 and the hermetic seal 720 are fixed to the upper portion of the housing. Meanwhile, the hermetic seal 720 is an insulating member for insulating the anode electrode 170 from the GND potential. The side of the housing of the second electron detection portion 700 is provided with fixed pieces 730 which are inserted into the positioning slits 612C provided to the pair of insulating support substrates 610A and 610B. Finally, the relative position between the pair of insulating support substrates 610A and 610B is fixed by bolts, so that these components are grasped by the pair of insulating support substrates 610A and 610B.

Meanwhile, as shown in FIG. 5, a metal plate 640 functioning as the bleeder circuit 230 is attached to the external side of the insulating support substrate 610A, and the twelfth-stage dynode DY12 and the first support substrate 510A (which is set to have the GND potential) are electrically connected to each other through a GND wire 650.

Figure 6A:
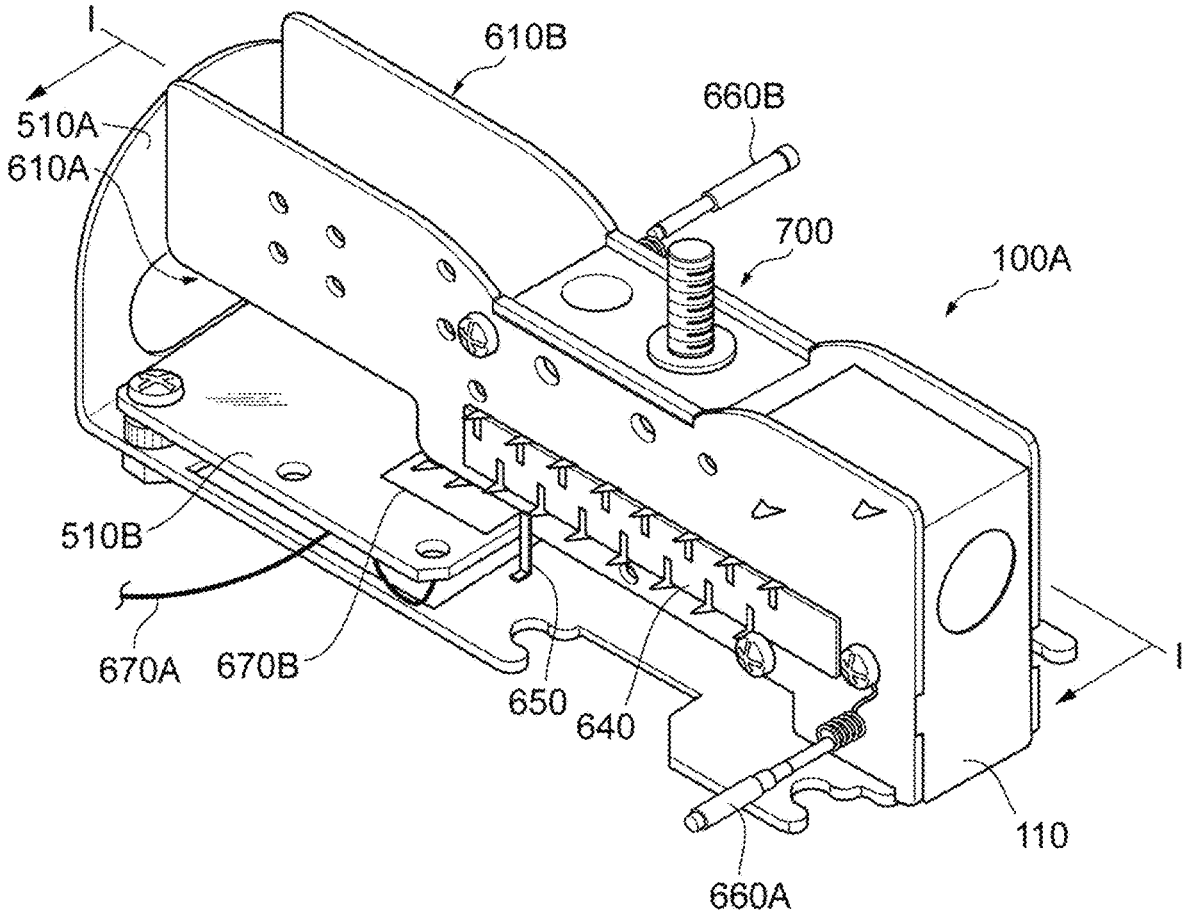
FIGS. 6A and 6B are a perspective view and a cross-sectional view illustrating a structure of the ion detector obtained through processes shown in FIGS. 4 and 5.
Figure 6B:
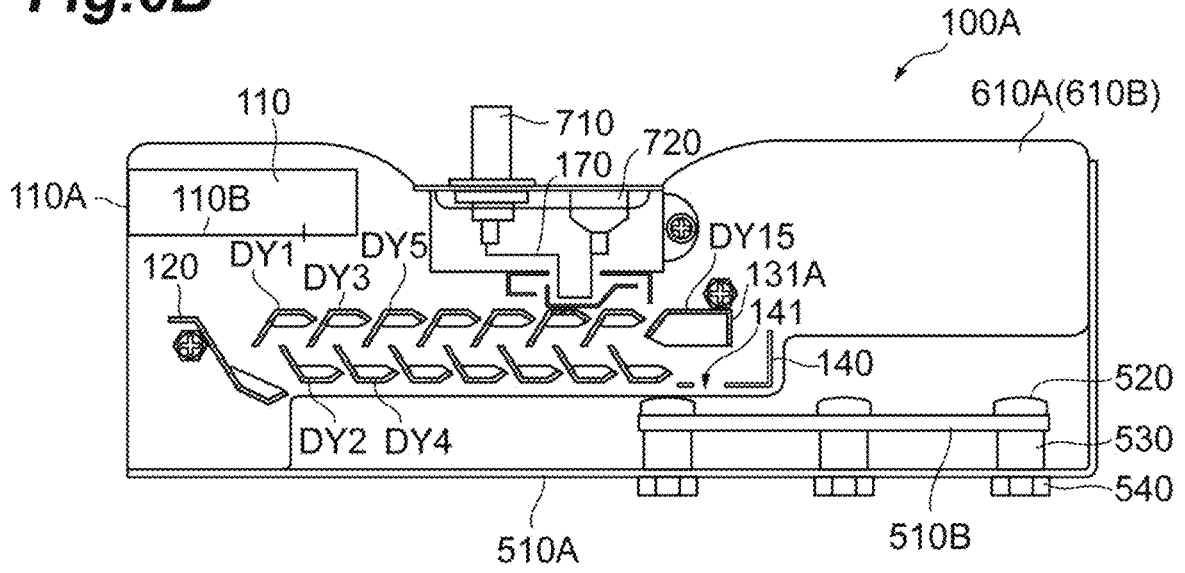

The electrode unit 600 obtained through the above assembly processes is attached to the base portion 500A, and thus the ion detector 100A as shown in FIG. 6A is obtained. Meanwhile, FIG. 6A is a perspective view illustrating a structure of the ion detector 100A obtained through the processes shown in FIGS. 4 and 5. In addition, FIG. 6B is a cross-sectional view of the ion detector 100A taken along line I-I of FIG. 6A. Meanwhile, the cross-sectional view shown in FIG. 1 is also equivalent to the cross-sectional view taken along line I-I of FIG. 6A. In addition, a wire 670A shown in FIG. 6A is a bias line of the AD 150, and a wire 670B is a supply line for setting a predetermined potential to the focus electrode 140.

As an example, when mention is made of the set potential of each part in the ion detector 100A according to the first embodiment, the potentials of the ion incidence portion 110 and the housing portion of the second electron detection portion 700 are set to GND. The potential of the conversion dynode 120 which is set by the dynode supply pin 660A is a negative potential of 0 V to −3,000 V. The potential of the twelfth-stage dynode DY12 is set to GND. The potential of the final-stage dynode DY15 which is set by the gate supply pin 660B is +300 V to +600 V in the case of the counting mode output. The potential of the focus electrode 140 is +600 V to +1,000 V. The bias voltage of the AD 150 is +3,500 V.

Second Embodiment

Figure 7A:
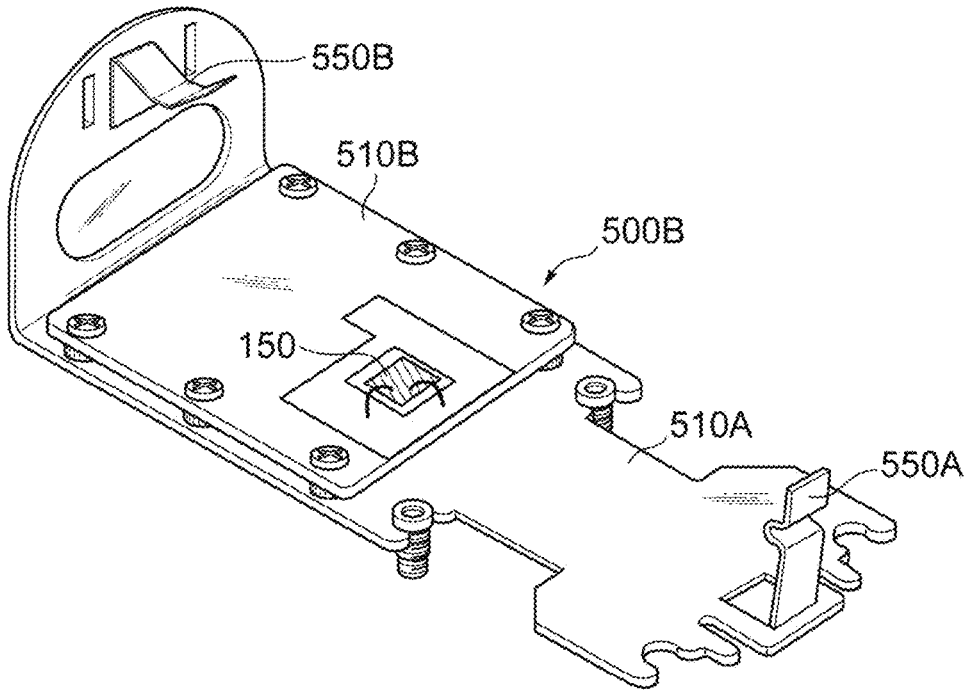
FIGS. 7A and 7B are a perspective view illustrating another structure example of the base portion (particularly, a first support substrate) in the ion detector according to the present embodiment and a cross-sectional view of the ion detector to which the base portion is applied.
Figure 7B:
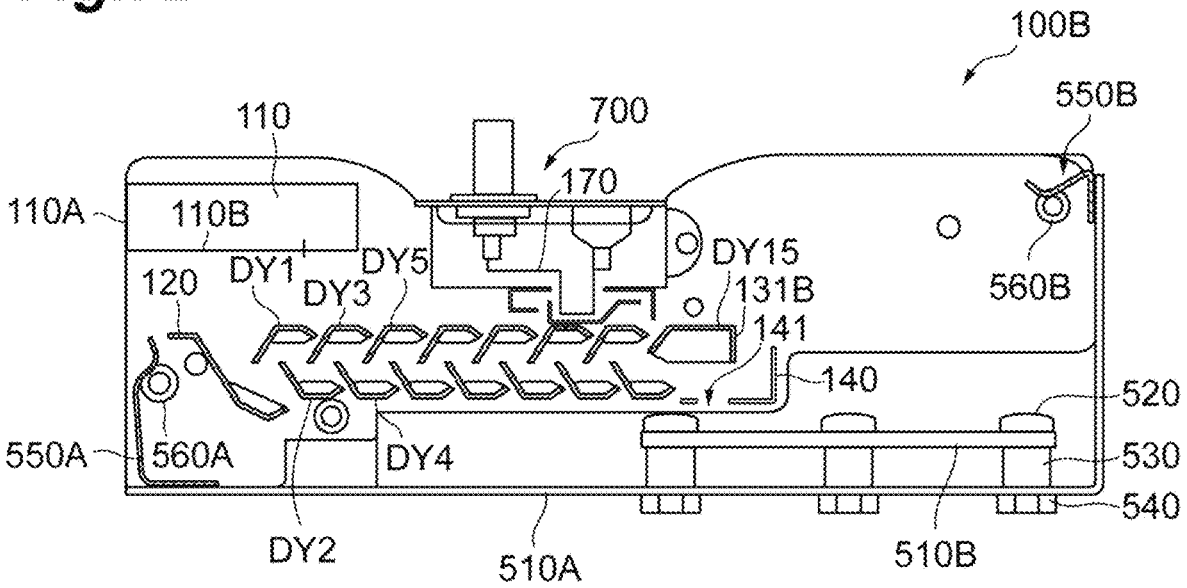

FIG. 7A is a perspective view illustrating another structure example of a base portion 500B (particularly, first support substrate) in an ion detector 100B according to a second embodiment, and FIG. 7B is a cross-sectional view of the ion detector 100B to which the base portion 500B is applied. The structure of the ion detector 100B according to the second embodiment is that in the first embodiment with the exception of the base portion 500B shown in FIG. 7A. Therefore, in the ion detector 100B, a wall portion 131B of the final-stage dynode DY15 also has a shape extending along a direction orthogonal to the electron multiplication direction AX1.

As shown in FIG. 7A, similarly to the first embodiment, the base portion 500B of the ion detector 100B is constituted by the first support substrate 510A and the second support substrate 510B which are fixed to each other in a state of being electrically insulated from each other. However, in the second embodiment, the first support substrate 510A is provided with a front fixing spring 550A and a rear fixing spring 550B on the front portion and the rear portion. On the other hand, as shown in FIG. 7B, the electrode unit 600 mounted on the base portion 500B is provided with a front fixing pole 560A which is brought into contact with the front fixing spring 550A and a rear fixing pole 560B which is brought into contact with the rear fixing spring 550B. Meanwhile, similarly to the first embodiment, the electrode unit 600 in the second embodiment also has a structure in which the ion incidence portion 110, the conversion dynode 120, the dynode unit 130, the focus electrode 140, and the second electron detection portion 700 are grasped by the pair of insulating support substrates 610A and 610B.

In a case where the electrode unit 600 is mounted on the base portion 500B having the structure as described above (that is, in a case where the electrode unit 600 is installed on the base portion 500B), the front fixing pole 560A and the rear fixing pole 560B of the electrode unit 600 are pressed by the base portion 500B due to the elastic forces of the front fixing spring 550A and the rear fixing spring 550B of the base portion 500B. Thereby, the electrode unit 600 is stably fixed to the base portion 500B.

Next, electrode structures of the second electron detection portion 700 (analog mode output) capable of being applied to any of the ion detectors 100A and 100B according to the first and second embodiments will be described in detail with reference to FIGS. 8A and 8B. Meanwhile, FIGS. 8A and 8B are diagrams illustrating examples of various electrode structures of the second electron detection portion 700 which are capable of being applied to the present embodiment (first to fourth embodiments).

As shown in FIG. 8A, in the ion detectors 100A and 100B according to the first and second embodiments, the anode electrode 170 of the second electron detection portion 700 is configured such that one end thereof is connected to the analog mode output terminal (analog port) 710, and that the other end thereof is connected to the hermetic seal (insulating member) 720 for insulating the anode electrode 170 from GND. The intermediate dynode DY11 adjacent to this anode electrode 170 is constituted by the dynode body DY11*a* and the mesh structure DY11*b* which are in contact with each other (the dynode body DY11*a* and the mesh structure DY11*b* are set to have the same potential). The dynode body DY11*a* is provided with the opening 620 for allowing passage of secondary electrons having reached the intermediate dynode. The mesh structure DY11*b* is provided with the mesh portion 631, and the mesh structure 132 of the intermediate dynode DY11 shown in FIG. 1 or the like is constituted by the opening 620 and the mesh portion 631.

In the electrode structure shown in FIG. 8A, the mesh opening ratio of the intermediate dynode DY11 is set to approximately 70% (=0.7). Meanwhile, the mesh opening ratio is given by a ratio of the total area of a mesh opening in the mesh structure DY11*b* to the opening area of the opening 620 provided in the dynode body DY11*a*.

Figure 8B:
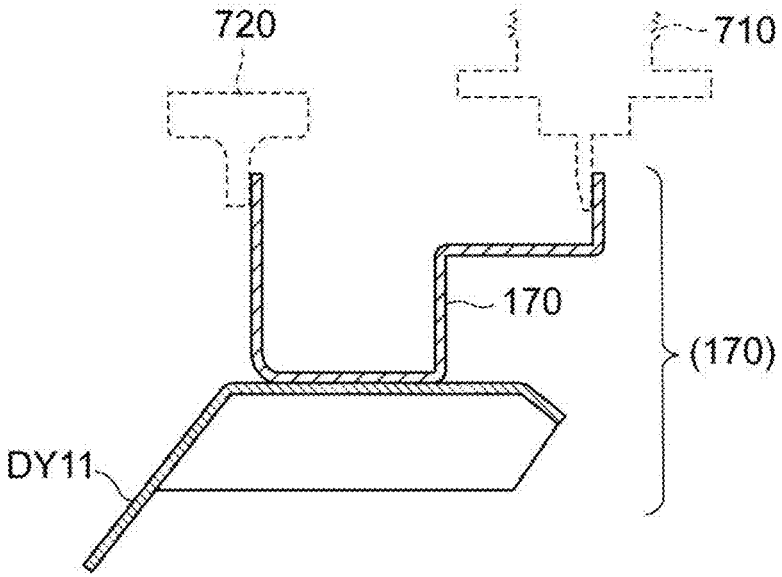

In the electrode structure shown in FIG. 8B, the anode electrode 170 is in direct contact with the intermediate dynode DY11 (the intermediate dynode DY11 is included in the anode electrode 170). Therefore, in the electrode structure of FIG. 8B, the mesh structure 132 (see FIG. 1 or the like) is not required for the intermediate dynode DY11. However, in the case of the electrode structure of FIG. 8B, regarding the structure of the bleeder circuit 230 shown in FIG. 2A, the structure within the region A is replaced with a structure shown in FIG. 2B. That is, in a case where the electrode structure of FIG. 8B is applied to the ion detectors 100A and 100B according to the first and second embodiments described above, in the gate part 240, replacement with the twelfth-stage dynode DY12 is performed as shown in FIGS. 2A and 2B, and a position which is set to V3 is changed with a wire 231 interposed therebetween. However, the intermediate dynode DY11 is included in the anode electrode 170, and thus is electrically isolated from the bleeder circuit 230.

Even in a case where the electrode structure of FIG. 8B is adopted, in the counting mode output, the potential of each electrode from the conversion dynode 120 to the final-stage dynode DY15 is set by a graph parallel to the graph G210 of FIG. 2C. In this case, the potential of the focus electrode 140 is set by a power supply separate from that of the bleeder circuit 230 shown in FIG. 2A. On the other hand, in a case where mode switching from the counting mode output to the analog mode output is performed by the switch SW, the potentials of the dynodes DY12 to DY15 constituting the gate dynode group 160 are all set to V3 or a negative potential lower than V3. Meanwhile, the set potentials of the dynodes DY12 to DY15 are not required to be identical with each other. As shown in graph G211B of FIG. 2C, a portion connected to the wire 231 (the intermediate dynode DY11 is electrically isolated from the bleeder circuit 230) which is located between the tenth-stage dynode DY10 and the twelfth-stage dynode DY12 is set to have a potential V3 (=GND), and the final-stage dynode DY15 is set to have a potential V3 (<GND), so that a potential gradient s shown in the graph G211B of FIG. 2C may be formed. In addition, since the potential of the anode electrode 170 including the intermediate dynode DY11 is a positive potential, a function of shielding secondary electrons by the gate part 240 is realized.

Third and Fourth Embodiments

Figure 9A:
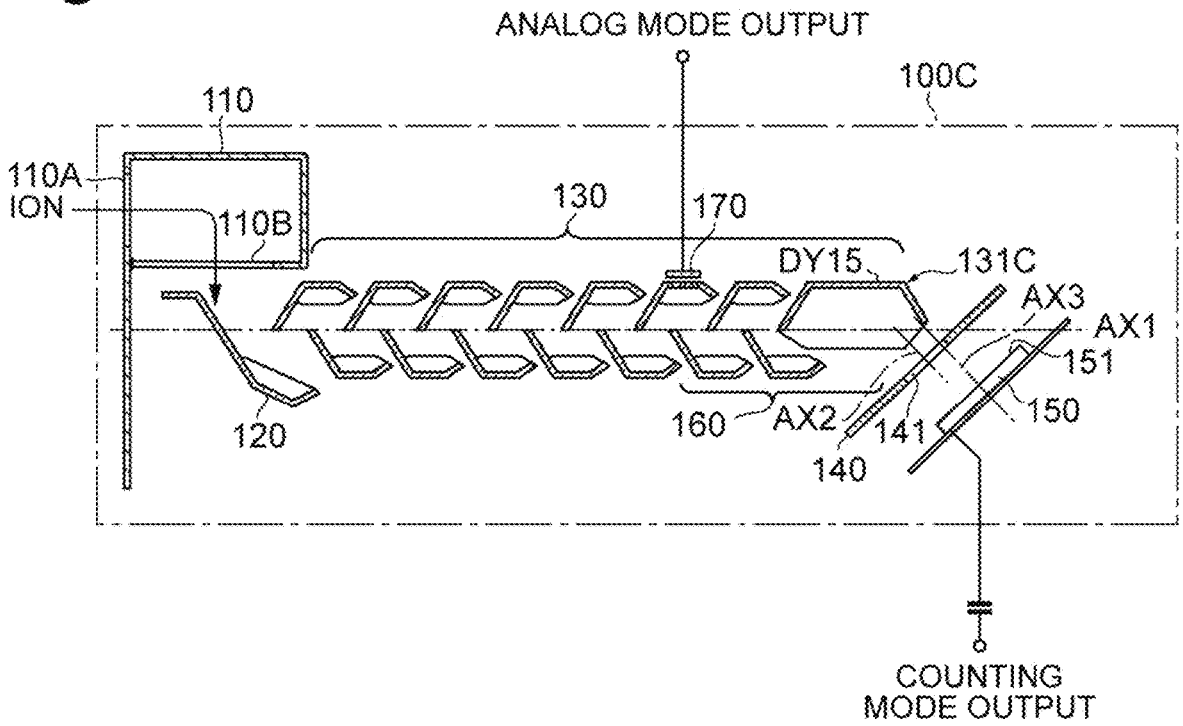
FIGS. 9A and 9B are cross-sectional views illustrating various modification examples of the ion detector according to the present embodiment.
Figure 9B:
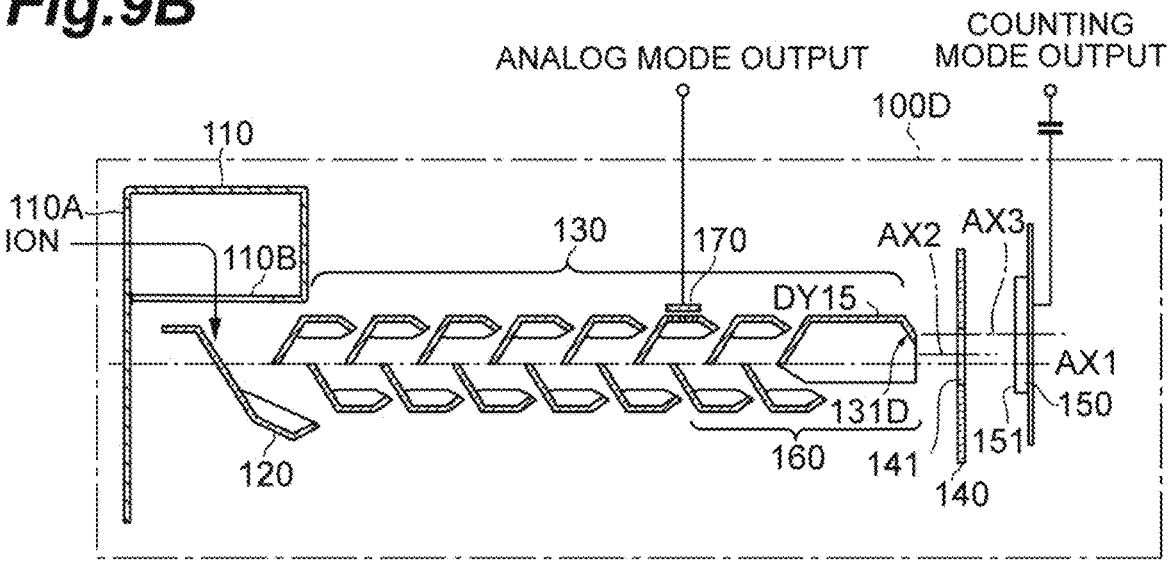

FIGS. 9A and 9B are cross-sectional views illustrating various modification examples of ion detectors according to the present embodiments. Meanwhile, similarly to FIG. 1, both FIGS. 9A and 9B show main parts of the ion detectors according to the present embodiments. In addition, the cross-sectional views shown in FIGS. 9A and 9B are equivalent to a cross-sectional view taken along line I-I of FIG. 6A. That is, any of ion detectors 100C and 100D according to the third and fourth embodiments includes the same structure as that of the ion detector 100A according to the first embodiment, with the exception of the structures of wall portions 131C and 131D of the final-stage dynode DY15, the installation position of the focus electrode 140, and the installation position of the AD 150.

In the ion detector 100C according to the third embodiment shown in FIG. 9A, the final-stage dynode DY15 has the wall portion 131C extending along a direction intersecting the electron multiplication direction AX1 at an acute angle. That is, in the configuration example of FIG. 9A, the trajectory of secondary electrons emitted from the final-stage dynode DY15 is corrected by the wall portion 131C provided in the final-stage dynode DY15 so that the secondary electrons travel along a direction intersecting the electron multiplication direction AX1 at an acute angle. The focus electrode 140 is also disposed so that the normal line AX2 that passes through the center of the opening 141 intersects the electron multiplication direction AX1 at an acute angle. Similarly, the AD 150 is also disposed so that the normal line AX3 that passes through the center of the electron incidence surface 151 intersects the electron multiplication direction AX1 at an acute angle. In addition, in order to more accurately control the trajectory of the secondary electrons, the focus electrode 140 and the AD 150 are disposed so that the normal lines AX2 and AX3 deviate from each other.

As described above, since the wall portion 131C provided in the final-stage dynode DY15 controls the trajectory of the secondary electrons emitted from the final-stage dynode DY15, it is possible to arbitrarily set the installation positions of the focus electrode 140 and the AD 150 with respect to the dynode unit 130.

On the other hand, in the ion detector 100D according to the fourth embodiment shown in FIG. 9B, the final-stage dynode DY15 also has the wall portion 131D, but this wall portion 131D does not have a function of substantially deflecting the trajectory of the secondary electrons emitted from final-stage dynode DY15. That is, in the fourth embodiment, the wall portion 131D provided in the final-stage dynode DY15 is substantially required, but a problem pertaining to practical use does not occur insofar as the wall portion is of such a length as not to be influenced by the trajectory of the secondary electrons emitted from the final-stage dynode DY15. Therefore, the focus electrode 140 and the AD 150 in the fourth embodiment are disposed along the electron multiplication direction AX1.

Specifically, in the fourth embodiment, the focus electrode 140 is disposed so that the normal line AX2 that passes through the center of the opening 141 is parallel to the electron multiplication direction AX1. Similarly, the AD 150 is also disposed so that the normal line AX3 that passes through the center of the electron incidence surface 151 is parallel to the electron multiplication direction AX1. In addition, in order to stabilize the trajectory of the secondary electrons which are directed from the final-stage dynode DY15 toward the electron incidence surface 151 of the AD 150, the focus electrode 140 and the AD 150 are disposed so that the normal lines AX2 and AX3 deviate from each other.

Fifth Embodiment

An ion detector according to a fifth embodiment includes the same structure (basic structure) as that of the first embodiment shown in FIG. 1 and the second embodiment shown in FIGS. 7A and 7B, with the exception of the structure and gate part 240 for obtaining the anode mode output. Meanwhile, in a case where the installation positions of the focus electrode 140 and the AD 150 are disregarded, the ion detector according to the fifth embodiment includes the same basic structure as those of the third and fourth embodiments shown in FIGS. 9A and 9B. In the fifth embodiment, the gate part 240 is not required with the exception of the gate dynode group 160 constituted by the dynodes DY12 to DY15 in the bleeder circuit 230 shown in FIGS. 2A and 2B. That is, the ion detector according to the fifth embodiment is a single-mode ion detector that performs only the counting mode output. Meanwhile, referring to FIG. 1, a structure, excluded from the configuration of the fifth embodiment, for obtaining the anode mode output includes the anode electrode 170 for capturing secondary electrons multiplied by the conversion dynode 120 and the dynodes DY1 to DY11, and the mesh structure 132 for allowing passage of some of secondary electrons having reached the intermediate dynode DY11 to the anode electrode 170 side. Therefore, the structure of the dynode DY11 in the fifth embodiment is the same as the structure shown in FIG. 8B.

Therefore, the ion detector according to the fifth embodiment includes the ion incidence portion 110, the conversion dynode 120, the dynode unit 130 including the gate dynode group 160, the focus electrode 140, and the AD 150. In this configuration, the potential of the ion incidence portion 110 is set to GND. In addition, the ion incidence portion 110 controls the trajectory of ions by adjusting the relative position between the incidence port 110A and the emission port 110B. each of the conversion dynode 120 and the dynodes DY1 to DY15 constituting the dynode unit 130 is set to have a predetermined potential by the bleeder circuit 230 (configuration in which the gate part 240 except the gate dynode group 160 is excluded in the configurations shown in FIGS. 2A and 2B). Specifically, the potential of the conversion dynode 120 is set to 0 to −6,500 V. On the other hand, the potential of the final-stage dynode DY15 is set to +300 V to +600 V. The set potentials of the dynodes DY1 to DY14 disposed between the conversion dynode 120 and the final-stage dynode DY15 are determined by a voltage drop of each resistor, connected in serial, which constitutes the bleeder circuit 230. Meanwhile, similarly to the first and second embodiment, the potential of the focus electrode 140 is set to +600 V to +1,000 V. In addition, a voltage (potential difference based on GND) which is applied to the AD 150 is +3,500 V.

As described above, according to the present invention, at least a portion of the subsequent stage portion of the electron multiplication mechanism constituted by multiple stages of dynodes is replaced with a semiconductor detector having an electron multiplication function, so that degradation over time in the electron multiplication mechanism is effectively suppressed. Particularly, in a dual-mode ion detector, degradation (degradation over time) in an electron multiplication factor in a portion of the electron multiplication mechanism which is contributes to the counting mode output is improved.

From the present invention thus described, it will be obvious that the embodiments of the present invention may be varied in many ways. Such variations are not to be regarded as a departure from the spirit and scope of the present invention, and all such modifications as would be obvious to those skilled in the art are intended for inclusion within the scope of the following claims.

What is claimed is:

1. An ion detector comprising:

an ion incidence portion;

a conversion dynode disposed at a position where ions taken up through the ion incidence portion reach, the conversion dynode emitting secondary electrons in response to incidence of the ions;

a dynode unit for cascade-multiplying secondary electrons emitted from the conversion dynode, the dynode unit being constituted by multiple stages of dynodes disposed along a predetermined electron multiplication direction;

a first electron detection unit that includes a semiconductor detector having an electron multiplication function, the first electron detection unit being configured such that the semiconductor detector is disposed at a position where secondary electrons emitted from a final-stage dynode included in the dynode unit reach;

a focus electrode disposed on a trajectory of secondary electrons which are directed from the final-stage dynode toward the first electron detection unit, the focus electrode having an opening for allowing passage of secondary electrons emitted from the final-stage dynode;

a first support substrate on which an electrode unit including at least the conversion dynode, the dynode unit, and the focus electrode is mounted while being physically separated from at least the focus electrode; and a second support substrate disposed between the focus electrode and the first support substrate, the second support substrate having a surface on which at least the first electron detection unit is directly mounted.

2. The ion detector according to claim 1, wherein the final-stage dynode included in the dynode unit has a first wall portion deflecting a traveling direction of secondary electrons, the first wall portion being in direct contact with the final-stage dynode and extending along a direction intersecting the electron multiplication direction, and the focus electrode and the semiconductor detector are disposed along the traveling direction of secondary electrons.

3. The ion detector according to claim 2, wherein the first wall portion of the final-stage dynode included in the dynode unit extends along a direction orthogonal to the electron multiplication direction, the focus electrode is disposed so that a first normal line that passes through a center of the opening is orthogonal to the electron multiplication direction, and the semiconductor detector is disposed so that second normal line that passes through a center of an electron incidence surface of the semiconductor detector is orthogonal to the electron multiplication direction.

4. The ion detector according to claim 3, wherein the focus electrode and the semiconductor detector are disposed so that the first normal line and the second normal line are parallel to each other and separated from each other by a predetermined distance.

5. The ion detector according to claim 1, wherein the focus electrode is disposed so that a third normal line that passes through a center of the opening is parallel to the electron multiplication direction, and the semiconductor detector is disposed so that a fourth normal line that passes through a center of an electron incidence surface of the semiconductor detector is parallel to the electron multiplication direction.

6. The ion detector according to claim 5, wherein the focus electrode and the semiconductor detector are disposed so that the third normal line and the fourth normal line are parallel to each other and separated from each other by a predetermined distance.

7. The ion detector according to claim 1, wherein the focus electrode has a second wall portion being in direct contact with the focus electrode and extending along a direction intersecting the electron multiplication direction.

8. The ion detector according to claim 1, wherein the second support substrate is electrically insulated from the first support substrate.

9. The ion detector according to claim 8, wherein a relative position between the first and second support substrates is fixed in a state where the first and second support substrates are capable of being physically separated from each other.

10. The ion detector according to claim 1 further comprising a second electron detection unit, disposed adjacent to any intermediate dynode other than the final-stage dynode among dynodes constituting the dynode unit, which has an electrode for capturing at least some of secondary electrons having reached the intermediate dynode.

11. The ion detector according to claim 1, further comprising a second electron detection unit that has an electrode including any intermediate dynode other than the final-stage dynode among dynodes constituting the dynode unit.

12. The ion detector according to claim 1, wherein the ion incidence portion has a first opening and a second opening through which the ions respectively pass, the first opening being disposed on a first plane, the ions passing through the first opening, the second opening being disposed on a second plane intersecting the first plane.

13. The ion detector according to claim 1, wherein the surface of the second support substrate is a continuous surface on which both the first electron detection unit and an electrode pad are directly mounted.

* * * * *